US009884322B2

(12) United States Patent
Knight et al.

(10) Patent No.: US 9,884,322 B2
(45) Date of Patent: Feb. 6, 2018

(54) STAND FOR MICROPLATES

(75) Inventors: Jan Knight, Plymouth (GB); Robert Knight, Plymouth (GB)

(73) Assignee: Abel Applications Limited, Plymouth, Devon (GB)

( * ) Notice: Subject to any disclaimer, the term of this patent is extended or adjusted under 35 U.S.C. 154(b) by 0 days.

(21) Appl. No.: 13/884,738

(22) PCT Filed: Nov. 11, 2011

(86) PCT No.: PCT/GB2011/052193
§ 371 (c)(1),
(2), (4) Date: Jul. 23, 2013

(87) PCT Pub. No.: WO2012/066310
PCT Pub. Date: May 24, 2012

(65) Prior Publication Data

US 2013/0336853 A1 Dec. 19, 2013

(30) Foreign Application Priority Data

Nov. 15, 2010 (GB) ..... 1019245.8

(51) Int. Cl.
*B01L 9/00* (2006.01)

(52) U.S. Cl.
CPC ..... *B01L 9/523* (2013.01); *B01L 2200/087* (2013.01)

(58) Field of Classification Search
CPC ..... B01L 9/52; B01L 9/523; B01L 2200/087
USPC ..... 108/4, 33–36, 42, 106, 108, 162; 422/560, 561, 563, 566
See application file for complete search history.

(56) References Cited

U.S. PATENT DOCUMENTS

| | | | | |
|---|---|---|---|---|
| 5,322,025 | A * | 6/1994 | Sherman et al. | 108/147 |
| 5,380,493 | A * | 1/1995 | Chavez | B01L 9/50 211/85.13 |
| 6,105,508 | A * | 8/2000 | Ryburg | 108/42 |
| 2007/0202018 | A1 | 8/2007 | Chu et al. | |
| 2010/0187063 | A1* | 7/2010 | Sperry | 190/11 |

FOREIGN PATENT DOCUMENTS

| | | |
|---|---|---|
| EP | 2034316 A1 | 3/2009 |
| GB | 2386153 A | 9/2003 |

* cited by examiner

*Primary Examiner* — Jill Warden
*Assistant Examiner* — Dwayne K Handy
(74) *Attorney, Agent, or Firm* — Rudy J. Ng; Bret E. Field; Bozicevic, Field & Francis LLP

(57) ABSTRACT

A laboratory stand for a microplate comprises a base (2), at least one post (3, 4) extending upwardly from the base, a shelf (5) located above the base and supported by the at least one post, and means for adjusting the height of the shelf in relation to the base. The shelf (5) comprises a rear portion (9) which is substantially horizontal and a front portion (10), which is inclined downwards away from the horizontal, which is adapted to retain at least one microplate. The laboratory stand improves pipetting ergonomics.

15 Claims, 4 Drawing Sheets

STAND FOR MICROPLATES

The present invention relates to a stand for microplates. In particular, it relates to a stand for use in a laboratory on which a microplate may be mounted or otherwise supported and presented at an angle and at an adjustable height to facilitate use.

A microplate, also known as a microtitre plate, is a flat plate provided with multiple wells typically arranged in a rectangular matrix. Microplates are commonly used in analytical research and in clinical diagnostic testing laboratories.

When pipetting liquid components into microplate wells, it is recommended that the user touches the pipette tip off against the side wall of the well to ensure accurate addition of the liquid component from the pipette. If the microplate is provided on a horizontal surface, the use of the pipette has to hold the pipette at an angle to ensure correct procedure. Unfortunately, the continual repetition of this action by the user can be physically tiring for the user and can cause the user to suffer from aching in the back, shoulders and/or arms. In order to address this problem, it has previously been proposed to mount the microplate on a stand which presents the microplate at an angle facing the user. This allows improved manipulation of pipette additions and enables the user to view the contents of the wells without having to lean over the microplate. Previously proposed microplate stands have included both fixed angle stands and tiltable stands, the latter allowing adjustment of the angle of tilt. Unfortunately, these prior art stands do not allow the height of the microplate to be adjusted and, therefore, a regular user of microplates, depending on his or her own height, may still suffer from aches in the back or shoulders caused by the need to make continual repetitive movements over the microplate during use thereof. These conventional microplate stands, also, do not provide any working surface adjacent to the microplate which provides storage for reagents and/or for well matrix templates to aid the user.

To overcome the disadvantages of the prior art and to improve pipetting ergonomics, the present invention provides a laboratory stand for a microplate which stand comprises a base, at least one post extending upwardly from the base, a shelf located above the base and supported by the at least one post, means for adjusting the height of the shelf in relation to the base, the shelf comprising a rear portion which is substantially horizontal and a front portion which is inclined downwards away from the horizontal, the front portion being adapted to retain at least one microplate.

Preferably, the stand comprises two posts extending upwardly from the base which two posts are parallel or substantially parallel to each other and wherein the shelf is supported on both posts. The posts may be free-standing and, typically, will be removable from the base so that they may be detached from the base and laid flat in or on the base when not in use. The posts will preferably be capable of being locked into their upright position by suitable locking means.

When two parallel posts are provided, these, according to a preferred embodiment of the invention, are linked at their uppermost ends so as to form an inverted U-shape frame.

The height of the shelf over the base is adjustable. This may be achieved by providing the shelf with one or more slots through which the post or posts may pass such that the shelf is slideable up and down the posts. In such a case, the position of the shelf on the one or more posts can be fixed so that once the desired height of the shelf on the posts has been selected, the shelf is prevented from independently moving with respect to the posts. According to another embodiment, the at least one post is telescopic, i.e. it has sections that slide within or over one another so as to change the overall length of the post.

The shelf comprises a rear portion which, when it is retained on the upright posts, is substantially horizontal and, further, comprises a front portion which is inclined downwards away from the horizontal and which front portion is adapted such that a microplate can be mounted thereon. Thus, when the stand is in use, the downwardly inclined front portion of the shelf is presented towards the user. The angle of inclination is such that, when the stand is in use, reagents added to the wells of a microplate mounted on the front portion of the shelf do not spill out of the wells while, at the same time, enabling the user to see into the wells. To accommodate users of different heights, the angle of inclination of the front portion of the shelf may, according to a preferred embodiment, be adjustable. Such adjustability may be provided by means of a hinged relationship between the rear and front portions of the shelf and the means to fix the angle between the front and rear portions of the shelf, when selected.

Typically, the horizontal surface of the rear portion of the shelf is provided with one or more recessed areas. For instance, a recessed area may be provided which is wide enough to hold a removable trough for containing a reagent to be dispensed by a multi-channel pipette. Either the front portion or the rear portion of the shelf may, further, be provided with means for supporting information sheets or a matrix plan, for the assistance of the user.

According to a preferred embodiment, the shelf is adapted to retain a microplate in portrait mode or landscape mode. In order to aid the user in making the correct additions to the wells in the microplate or in keeping a record of additions made or to be made to the wells, the shelf may be provided with peg holes in the regions surrounding the location of a microplate which peg holes correspond to the rows and columns of the wells in the microplate array. The insertion of indicator pegs, such as colour pegs, into the appropriate holes can then act as an aide memoire for the user to indicate which additions of reagent have been made or are to be made to the wells. Alternatively, the shelf may be provided with slots in the regions surrounding the location of the microplate which slots are adapted to receive inserts that are optionally provided with peg holes corresponding to the rows/columns of the wells of the microplate.

A lamp, to illuminate the surface of the shelf and/or a microplate supported on the shelf, may also be provided as an attachment to the one or more posts.

The area of the shelf beneath the position of the microplate may be cut away or provided with a window, opening to the base below the shelf. If a translucent or transparent microplate is used, the base of the laboratory stand may be provided with a mirror positioned so as to reflect, to the user, an image of the underside of the wells of the microplate located on the shelf. Alternatively, the base may be provided with a light source, for example an LED backlit panel, which, when connected to a source of electrical power, illuminates the contents of the wells of the transparent or translucent microplate located on the shelf.

In order that the invention can be fully understood and readily carried into effect, the same will now be described by way of example only, with reference to the accompanying figures, of which:

Figure 1:
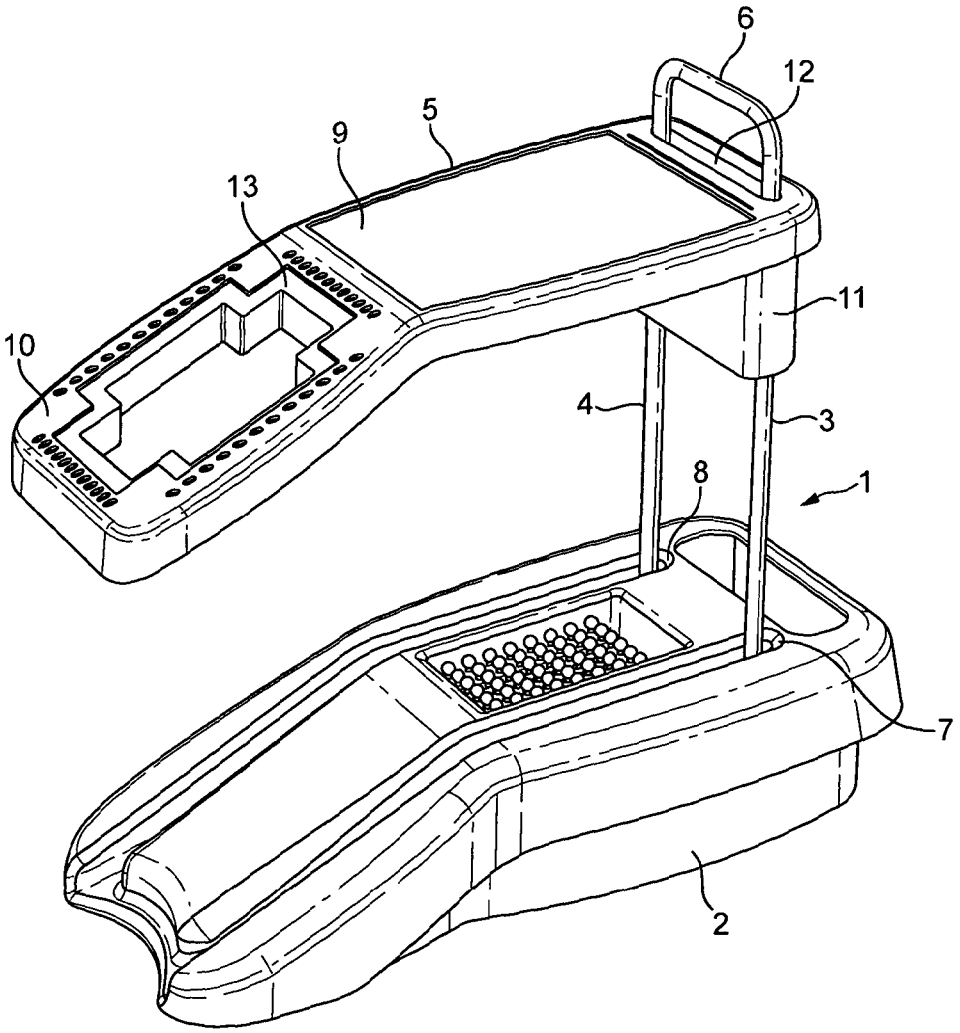
FIG. 1 is a perspective view of a laboratory stand according to the invention.

As shown in FIG. 1, the laboratory stand 1 comprises a base 2, two posts 3 and 4 extending upwardly from the base and a shelf 5. The two posts 3 and 4 are linked together to form an inverted U-shape frame 6 and each is retained in the base at 7 and 8, respectively, such that the frame does not collapse.

The shelf 5 comprises a rear portion 9 which is substantially horizontal and a front portion 10 which is tilted downwards from the rear portion 9. The shelf 5, on its underside, and located towards the rear of the shelf, is provided with a downwardly extending rigid support member 11. An open slot 12 is formed in the member 11 and the shelf 5 through which the posts 3 and 4 extend. The height of the shelf, in relation to the base, may be adjusted by sliding the shelf upwards or downwards on the posts 3 and 4. Frictional forces between the posts 3 and 4 and the internal surfaces of the slot 12 will normally be sufficient to hold the shelf at the selected height, thus preventing the shelf from free movement on the posts 3 and 4. However, other means of fixing the shelf in position on the posts may be used if desired. The posts, according to a different embodiment, may be formed of sections that slide within or over one another to allow the overall height to be adjusted telescopically (not shown).

The front portion 10 of the shelf 5 is provided with recessed surface 13 which is adapted to retain a microplate (not shown) in either a landscape position or a portrait position. According to a different embodiment, the area of the shelf lying immediately beneath the location of a microplate is cut away or provided with a window opening onto the base of the stand. If the microplate used is transparent or translucent, it can be illuminated by means of a light source located below the microplate, for instance on the base. Alternatively, a mirror can be located on the base so as to reflect, to the user, an image of the underside of the wells of the transparent/translucent microplate.

Figure 2:
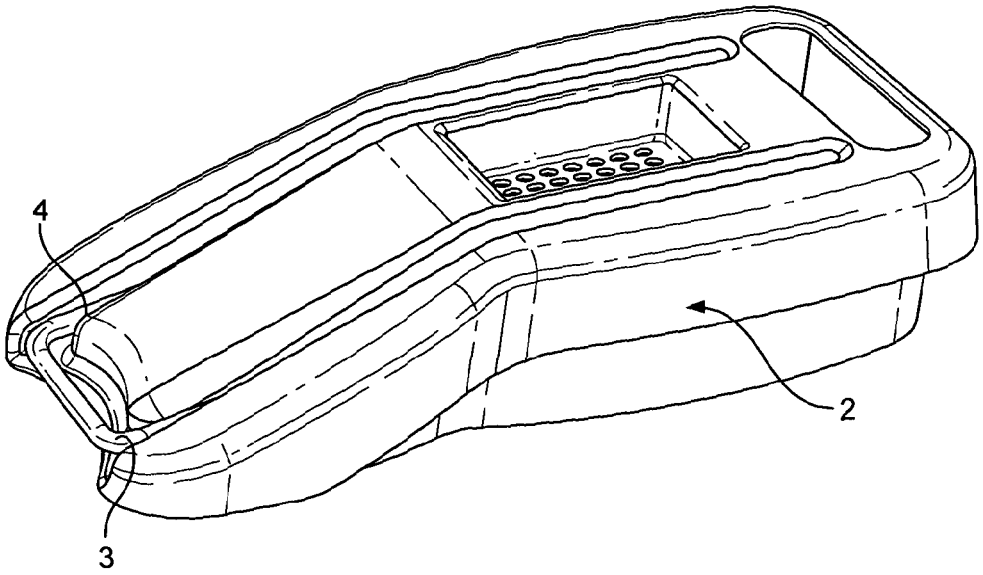
FIG. 2 is a perspective view of the base of the laboratory stand in disassembled configuration.
Figure 3:
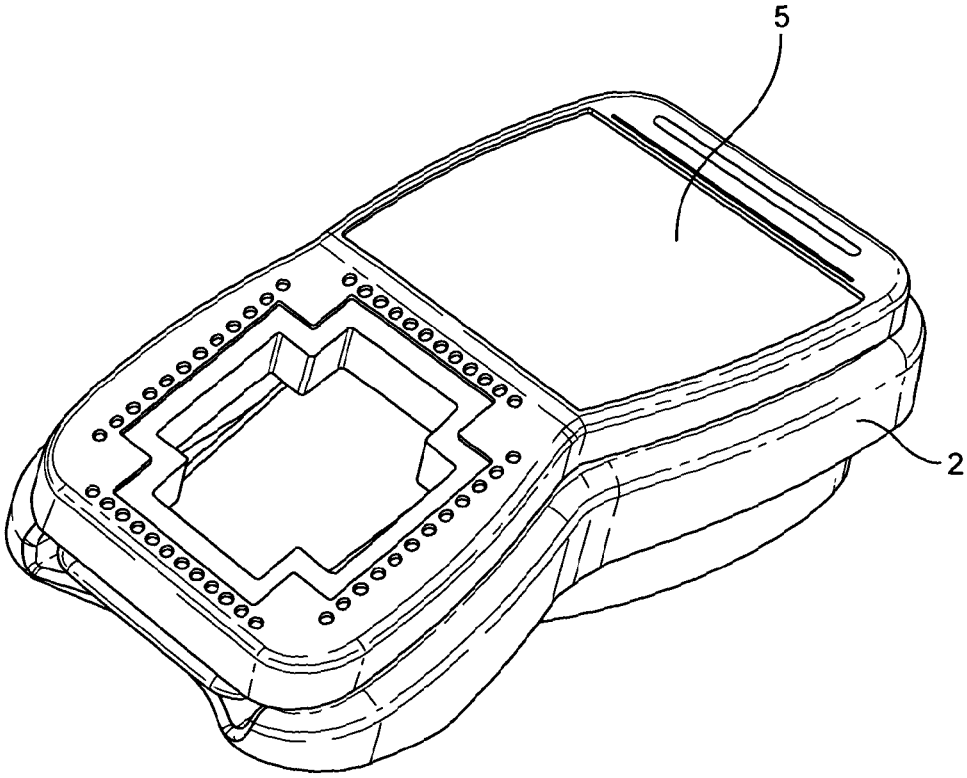
FIG. 3 is a perspective view of the disassembled components of the stand shown in FIG. 1 ready for storage.

FIG. 2 shows the base 2 of the stand of FIG. 1 with the shelf removed. The posts 3, 4 are detached from the base so as to lie flat on the base in the recesses provided. For ease of storage, when the stand is not in use, the shelf 5 may be retained on the base, as illustrated in FIG. 3.

Figure 4:
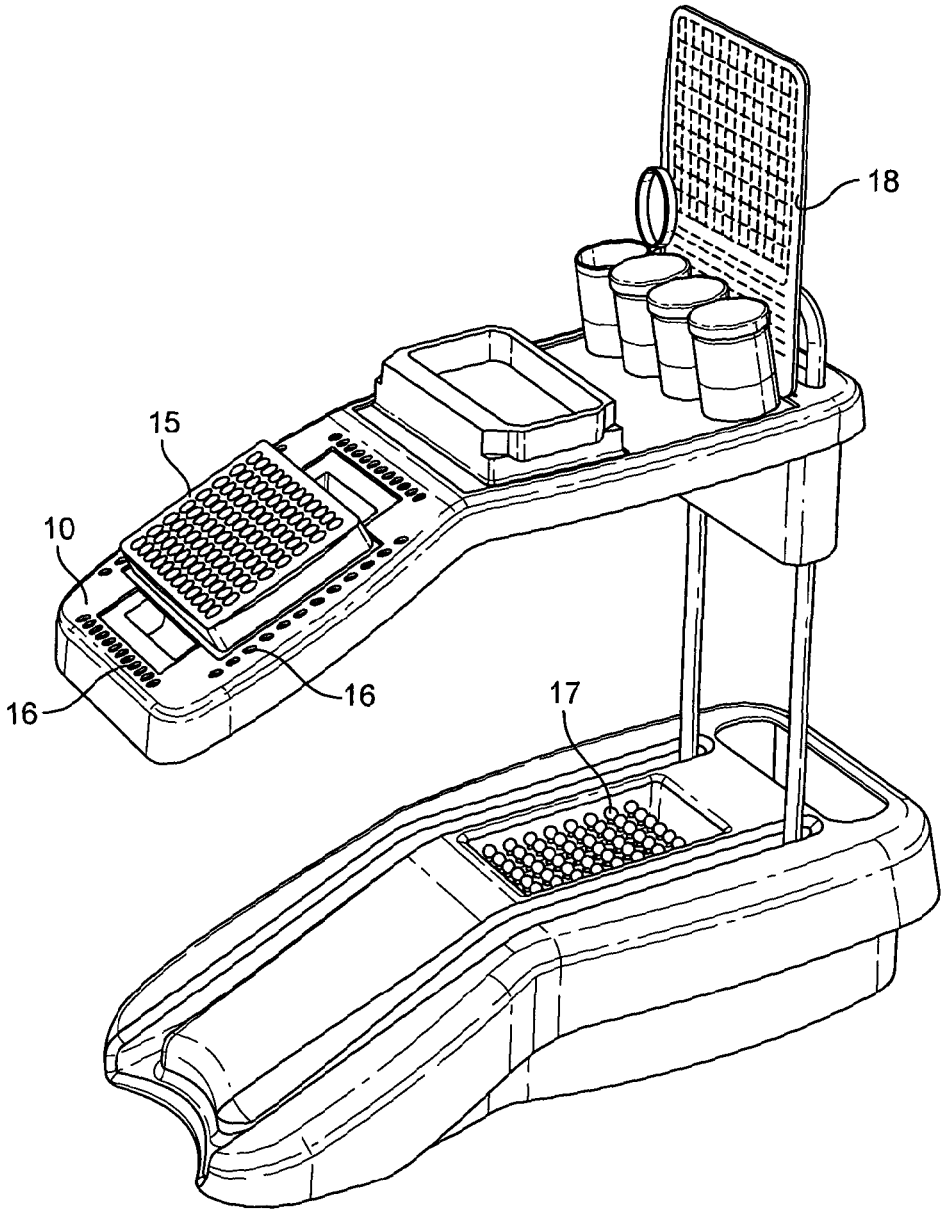
FIG. 4 is a perspective view of the stand of FIG. 1 in use.

The stand of the present invention is shown in use in FIG. 4. As mentioned previously, the shelf 5 has a front portion 10 which is tilted downwards with respect to the rear portion 9. The front portion 10 is adapted to retain a microplate 15. In the embodiment shown, the microplate 15 is retained on the front portion 10 in a landscape mode. The front portion 10 is formed with holes 16 surrounding recessed surface 13 for retaining indicator pegs. The holes correspond with the rows and columns of the wells in the microplate in either landscape or portrait mode. As shown, the base 2 is formed with a recessed portion 17 for retaining the indicator pegs when not in use.

The rear portion 9 of the shelf is designed to support reagent containers and a trough (for multi pipette use) for containing reagents for pipetting into the microplate wells. The rear portion 9 of the shelf is further provided with a groove for retaining and supporting a microplate array plan 18. Typically, this groove will be slanted backwards so that an array plan supported in the groove will be presented normal to the view of the user. Alternatively, the front portion 10 of the shelf 5 may be provided with a plate which slides out from beneath the shelf to provide a support for an array plan or other information sheet for use by the user.

Figure 5A:
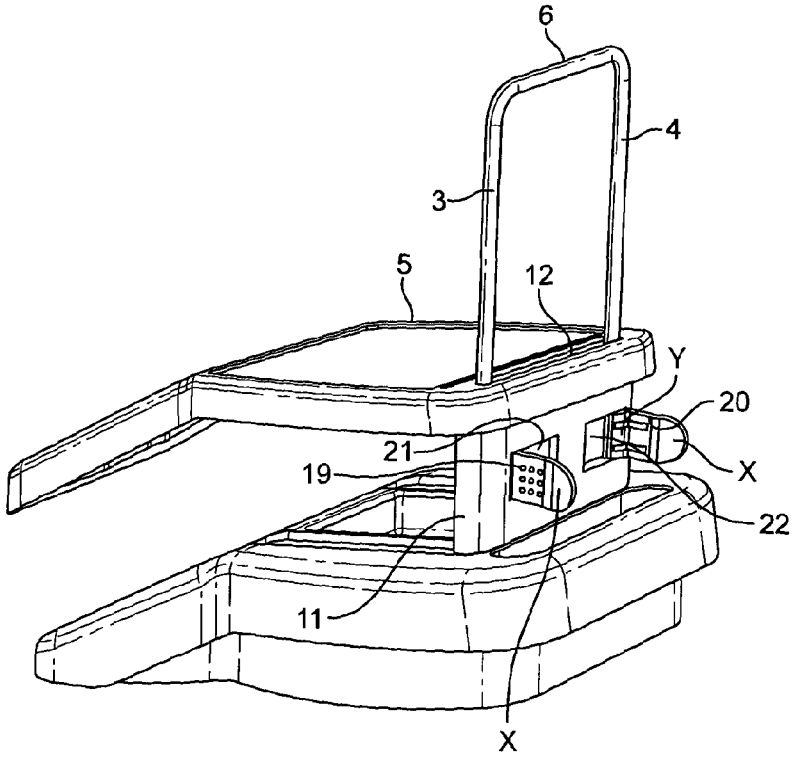
FIGS. 5A and 5B are perspective rear views of another embodiment of the invention.
Figure 5B:
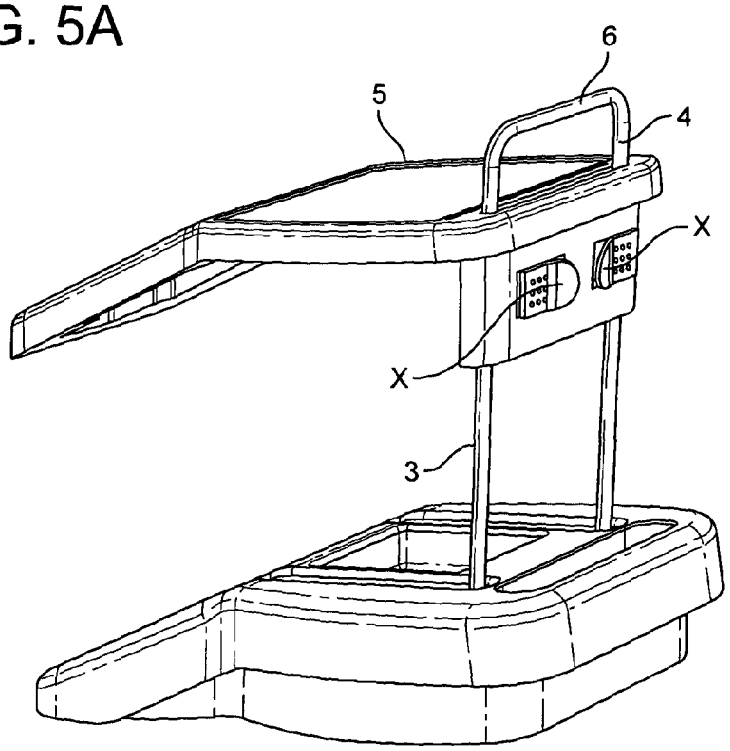

FIGS. 5A and 5B illustrates an embodiment of the invention wherein locking means are provided to lock the shelf 5 into a desired vertical position on the posts 3 and 4 of the frame 6. The locking means comprise two locking levers 19, 20 which are pivotably mounted into recesses 21, 22, respectively, formed into the rear surface of the support member 11. Each of the locking levers 19, 20 comprises a flap X and an internal portion Y.

When the flap X of a locking lever is opened, as shown in FIG. 5A, the internal portion Y is held in a position remote from the post which passes through the slot 12 formed in the support member 11. When the desired height of the shelf 5 has been selected, the flap X is closed into the recess 21, 22, as shown in FIG. 5B, and this causes the internal portion Y of the locking lever to engage with, grip or be urged against the post so as to prevent any vertical movement of the shelf on the post.

The invention claimed is:

1. A laboratory stand comprising:

a stand adapted to retain at least one microplate, said stand comprising a base;

two posts extending upwardly from the base; and a shelf located above the base and supported by the posts, wherein the shelf comprises a rear portion which is substantially horizontal and a front portion which is tilted downwards from the rear portion, the front portion being adapted to retain at least one microplate, the rear portion of the shelf on its underside is provided with a downwardly extending rigid support member and a slot is provided through the rear portion of the shelf and through the downwardly extending rigid support member provided on the underside of the shelf, the posts extend through the slot such that the shelf is slidable on the posts to enable adjustment of the height of the shelf, and the downwardly extending rigid support member is provided with a lock for locking the shelf into position on the posts.

2. The laboratory stand according to claim 1 wherein the two posts extending upwardly from the base are parallel to each other.

3. The laboratory stand according to claim 1, wherein the posts form an inverted U-shape frame.

4. The laboratory stand according to claim 3, wherein the posts are firmly and removably attached to the base and are lockable in an upright position.

5. The laboratory stand according to claim 1, wherein the rear portion of the shelf is provided with a recessed tray.

6. The laboratory stand according to claim 5, wherein the recessed tray is wide enough to accommodate a trough for a multi-channel pipette.

7. The laboratory stand according to claim 5, wherein the recessed tray comprises a platform for storing one or more reagent containers.

8. The laboratory stand according to claim 1, wherein at least one of the front portion and the rear portion of the shelf comprises an information support for supporting information sheets for the user.

9. The laboratory stand according to claim 1, wherein the shelf is detachable from the posts and the posts are foldable down into the base for storage.

10. The laboratory stand according to claim 9, wherein the shelf has a shape such that, after it has been detached from the posts and the posts have been folded down into the base, it fits onto the base for storage.

11. The laboratory stand according to claim 1, wherein the shelf is provided with peg holes in the regions surrounding the location of a microplate which peg holes correspond to rows and columns of wells in a microplate.

12. The laboratory stand according to claim 8, wherein the information support comprises a groove for retaining and supporting the information sheets for the user.

13. The laboratory stand according to claim 11, wherein the base comprises a recessed portion for retaining one or more pegs.

14. The laboratory stand according to claim 1, wherein the lock comprises at least one locking lever pivotably mounted into a recess formed into the rear surface of the downwardly extending rigid support member, said locking lever having a portion which can be caused to engage with a post so as to prevent any vertical movement of the shelf on the post.

15. The laboratory stand according to claim 1, further comprising at least one microplate.

* * * * *